US005188206A

United States Patent [19]

Prince

[11] Patent Number: 5,188,206

[45] Date of Patent: Feb. 23, 1993

[54] SINGLE LEVER CONTROL

[75] Inventor: Anthony P. Prince, Waukegan, Ill.

[73] Assignee: Outboard Marine Corporation, Waukegan, Ill.

[21] Appl. No.: 737,388

[22] Filed: Jul. 29, 1991

Related U.S. Application Data

[63] Continuation-in-part of Ser. No. 573,368, Aug. 27, 1990, abandoned, which is a continuation-in-part of Ser. No. 272,544, Nov. 17, 1988, Pat. No. 4,951,520.

[51] Int. Cl.[5] ..... B60K 41/00; F16D 23/00; G05G 11/00

[52] U.S. Cl. ..... 192/0.098; 74/480 B; 74/876; 192/96

[58] Field of Search ..... 74/480 B, 876, 878, 74/879; 192/96, 98

[56] References Cited

U.S. PATENT DOCUMENTS

| | | | |
|---|---|---|---|
| D. 230,496 | 2/1990 | Stansthy | D34/15 A |
| 2,884,109 | 4/1959 | Morse | 192/0.098 |
| 2,957,352 | 10/1960 | Pierce | 74/.472 |
| 2,971,618 | 2/1961 | Morse | 192/0.096 |
| 3,117,465 | 1/1964 | Eiermann | 192/0.096 X |
| 3,250,350 | 5/1966 | Shimanckas | 192/0.096 |
| 3,503,638 | 3/1970 | Holzel | 287/20.3 |
| 3,530,736 | 9/1970 | Houk | 74/469 |
| 3,643,528 | 2/1972 | Vanderloos | 74/876 |
| 3,828,902 | 8/1974 | Saito et al. | 192/0.096 |
| 3,841,771 | 10/1974 | Shankwitz et al. | 403/163 |
| 4,022,536 | 5/1977 | Piepho et al. | 403/16 |
| 4,027,555 | 6/1977 | Rauchle et al. | 74/876 X |
| 4,090,598 | 5/1978 | Prince | 74/876 X |
| 4,119,186 | 10/1978 | Choudhury et al. | 192/0.096 |
| 4,129,047 | 12/1978 | Dornan | 74/474 |
| 4,144,956 | 3/1979 | Baba | 192/0.096 |
| 4,160,499 | 7/1979 | Baba | 192/0.098 |
| 4,205,738 | 6/1980 | Baba | 192/0.096 |
| 4,253,349 | 3/1981 | Floeter et al. | 74/878 |
| 4,555,199 | 11/1985 | Maier et al. | 403/370 |
| 4,572,023 | 2/1986 | Euler | 74/493 |
| 4,646,588 | 3/1987 | Wiater | 74/876 |
| 4,801,282 | 1/1989 | Ogawa et al. | 440/84 |

FOREIGN PATENT DOCUMENTS

| | | |
|---|---|---|
| 1152182 | 5/1969 | United Kingdom . |
| 2226386 | 6/1990 | United Kingdom . |

*Primary Examiner*—Leslie A. Braun
*Assistant Examiner*—David W. Laub
*Attorney, Agent, or Firm*—Michael, Best & Friedrich

[57] ABSTRACT

A single lever control for operating a throttle and a clutch, the control including a housing, a shaft pivotably supported by the housing, a shift mechanism operably connected to the shaft and adapted to be operably connected to the clutch, a throttle mechanism operably connected to the shaft and adapted to be operably connected to the throttle, and a hand-operable warm-up mechanism movable transversely of the shaft for permitting operation of the throttle mechanism without operation of the shift mechanism.

60 Claims, 6 Drawing Sheets

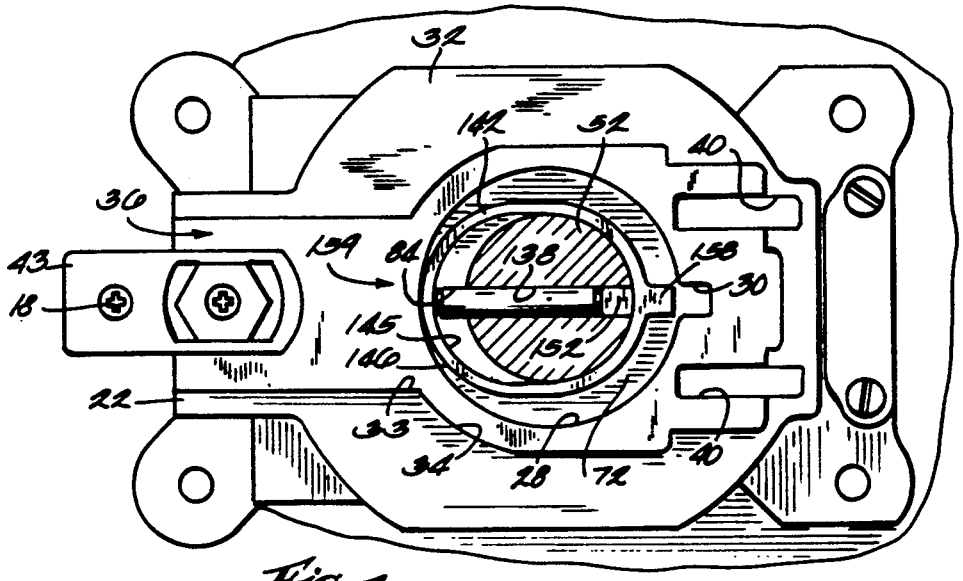
Fig. 4
Fig. 5
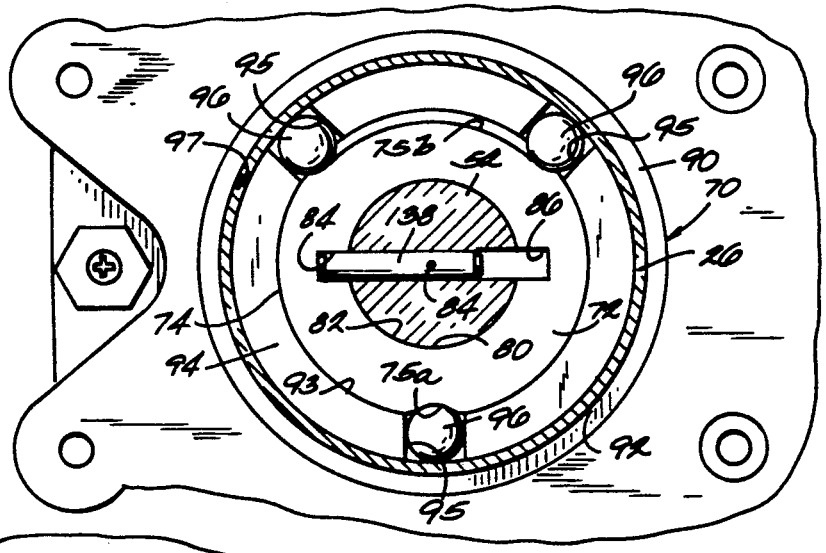
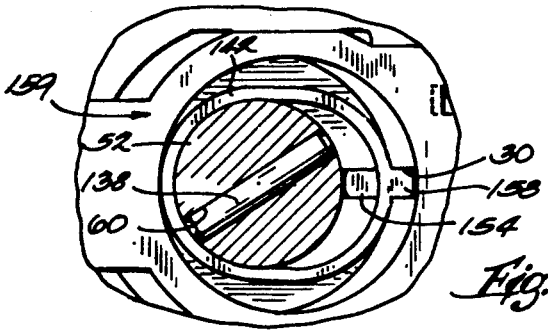
Fig. 9

SINGLE LEVER CONTROL

RELATED PATENTS

This application is a continuation-in-part of Ser. No. 573,368, filed Aug. 27, 1990, abandoned which is, in turn, a continuation-in-part of Ser. No. 272,544, U.S. Pat. No. 4,951,520 which was filed on Nov. 17, 1988 and which issued on Aug. 28, 1990.

BACKGROUND OF THE INVENTION

1. Technical Field

The invention relates generally to single lever controls, and more particularly, to single lever controls for operating the clutch and the throttle of a marine propulsion device.

2. Related Prior Art

Attention is directed to the following U.S. patents:

| | | |
|---|---|---|
| D0230,496 | Stastny | February 26, 1974 |
| 2,884,109 | Morse | April 28, 1959 |
| 2,957,352 | Pierce | October 25, 1960 |
| 3,250,350 | Shimanckas | May 10, 1966 |
| 3,503,638 | Holzel | March 31, 1970 |
| 3,530,736 | Houk | September 29, 1970 |
| 3,643,528 | Vanderloos | February 22, 1972 |
| 3,841,771 | Shankwitz et al. | October 15, 1974 |
| 4,022,536 | Piepho et al. | May 10, 1977 |
| 4,119,186 | Choudhury et al. | October 10, 1978 |
| 4,129,047 | Dornan | December 12, 1978 |
| 4,160,499 | Baba | July 10, 1979 |
| 4,253,349 | Floeter et al. | March 3, 1981 |
| 4,555,199 | Maier et al. | November 26, 1985 |
| 4,572,023 | Euler | February 25, 1986 |
| 4,801,282 | Ogawa et al. | January 31, 1989 |

SUMMARY OF THE INVENTION

The invention provides a single lever control for operating a throttle and a clutch, the control comprising a housing, a shaft pivotally supported by the housing, shift means operably connected to the shaft, adapted to actuate the clutch and including a shift actuating member pivotably supported by the housing to effect clutch actuation, a throttle actuating member operably connected to the shaft and adapted to be operably connected to the throttle, warm-up means for permitting operation of the throttle means without operation of the shift means and including a warm-up member movable transversely of the shaft between a first position and a second position, and releasable locking means for selectively affording rotation of the shift actuating member relative to the warm-up member when the warm-up member is in the first position to permit clutch actuation and alternatively for preventing rotation of the shift actuating member relative to the warm-up member when the warm-up member is not in the first position.

One embodiment of the invention provides a single lever control for operating a throttle and a clutch, the control comprising a housing, a shaft supported by the housing for pivotal movement about an axis, shift means operably connected to the shaft and adapted to actuate the clutch, throttle means operably connected to the shaft and adapted to be operably connected to the throttle, and warm-up means for permitting operation of the throttle means without operation of the shift means and including a warm-up member movable transversely of the axis, a locking member supported by the housing for movement between a first position wherein the locking member is engaged with the shaft for common rotation therewith relative to the warm-up member to permit shift actuation and a second position wherein the locking member is rotatable relative to the shaft, and selectively releasable locking means for preventing rotation of the locking member relative to the warm-up member to prevent shift actuation when the locking member is intermediate the first and second positions.

One embodiment of the invention provides a single lever control for operating a throttle and a clutch, the control comprising a housing, a shaft supported by the housing for pivotal movement about an axis and having therethrough a bore extending transversely to the axis, shift means operably connected to the shaft and adapted to be operably connected to the clutch, throttle means operably connected to the shaft and adapted to be operably connected to the throttle, warm-up means for permitting operation of the throttle means without operation of the shift means and including a locking member supported by the housing for movement between a first position and a second position, a pin housed in the bore and moveable longitudinally thereof between a first position wherein a portion of the pin extends from the bore and a second position wherein the pin is substantially free of projection beyond the shaft, means on the locking member for moving the pin between the first and second positions, and means for immediately effecting motion of the pin longitudinally of the bore in response to movement of the locking member between the first and second positions.

One embodiment of the invention provides a single lever control for operating a throttle and a clutch, the control comprising a housing, a shaft pivotally supported by the housing, shift means operably connected to the shaft for selectively actuating the clutch and including a shift actuating member supported by the housing for movement relative thereto to effect clutch actuation, a throttle control lever operably connected to the shaft and adapted to be operably connected to the throttle, and warm-up means for permitting operation of the throttle without operation of the shift means and including a warm-up member movable transversely of the shaft between a first position and a second position, and releasable locking means for selectively connecting the control lever and the shift actuating member to permit clutch actuation when the when the warm-up member is in the first position and alternatively and selectively for disconnecting the control lever and the shift actuating member and for preventing movement of the shift actuating member relative to the housing when the warm-up member is not in the first position.

One embodiment of the invention provides a single lever control for operating a throttle and a clutch, the control comprising a housing, a shaft pivotally supported by the housing for rotation about an axis, shift means operably connected to the shaft for actuating the clutch and including a shift actuating member pivotably supported by the housing for rotation about the axis to effect clutch actuation, a throttle actuating member operably connected to the shaft and adapted to be operably connected to the throttle, and warm-up means for permitting operation of the throttle means without operation of the shift means and including a warm-up member which is movable transversely of the axis between a first position and a second position, and a locking member connected to the shift actuating member for common rotational movement therewith about the axis and for movement relative thereto radially of the axis.

Other features and advantages of the invention will become apparent to those skilled in the art upon review of the following detailed description, claims and drawings.

DESCRIPTION OF THE DRAWINGS

FIG. 4 is a view similar to FIG. 3 with the warm-up rod and springs removed for illustration.

FIG. 5 is a view similar to FIG. 4 with the locking ring removed for illustration.

FIG. 9 is a view similar to FIG. 8 with the shaft in a rotated position.

Figure 1:
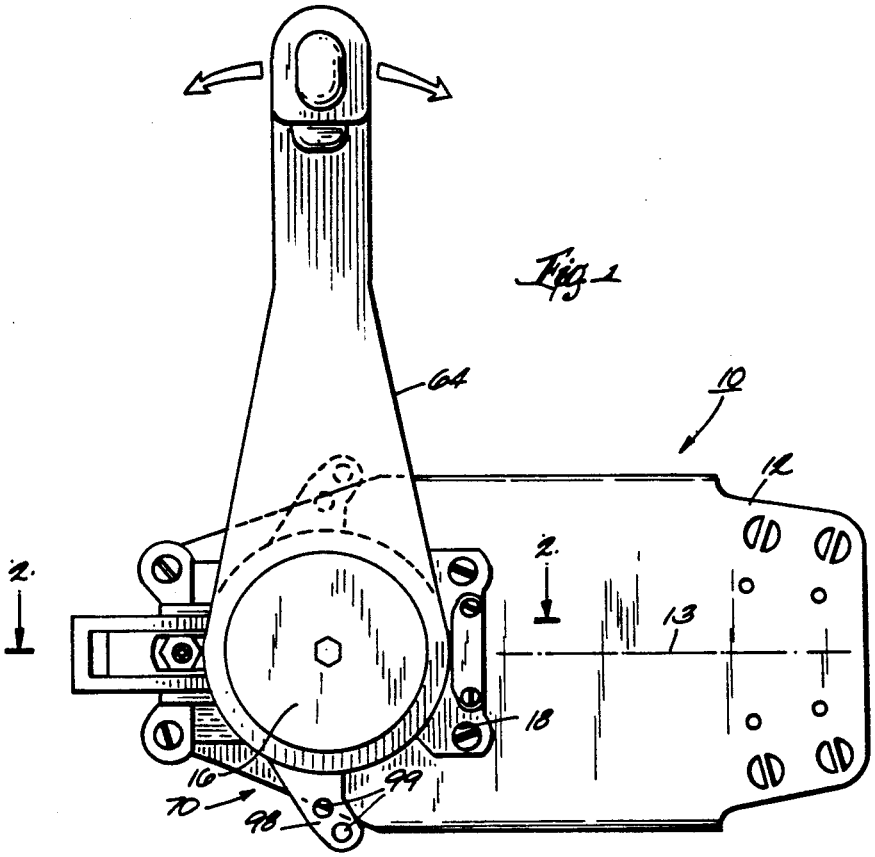
FIG. 1 is a side elevational view of a single lever control embodying various features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

A single lever control 10 embodying the invention is illustrated in the drawings.

The control 10 includes (FIG. 1) a generally planar support plate 12 which has therein (FIG. 2) a generally circular bore 14, the reason for which is explained hereinafter. Support plate 12 is adapted to be mounted to a wall (not shown), such as the gunwale of a boat, and, as discussed below, is adapted to be operably connected to an engine (not shown), such as a marine propulsion device.

The control 10 also includes a generally planar cover plate 16 which is removably secured to the support plate 12 by (FIG. 1) suitable fastening means 18. The cover plate 16 also includes (see FIG. 2) a generally circular bore 20 which, when the cover plate 16 is mounted on the support plate 12, is substantially coaxially aligned with the bore 14 in the support plate 12.

The control 10 also includes (FIG. 2) a housing 22 which is removably secured to the support plate 12 by the fastening means 18 and which is sandwiched between the support plate 12 and the cover plate 16. The cover plate 16 and the housing 22 are arranged so that, when the cover plate 16 and the housing 22 are mounted on the support plate 12, the cover plate 16 substantially overlies the housing 22.

Figure 2:
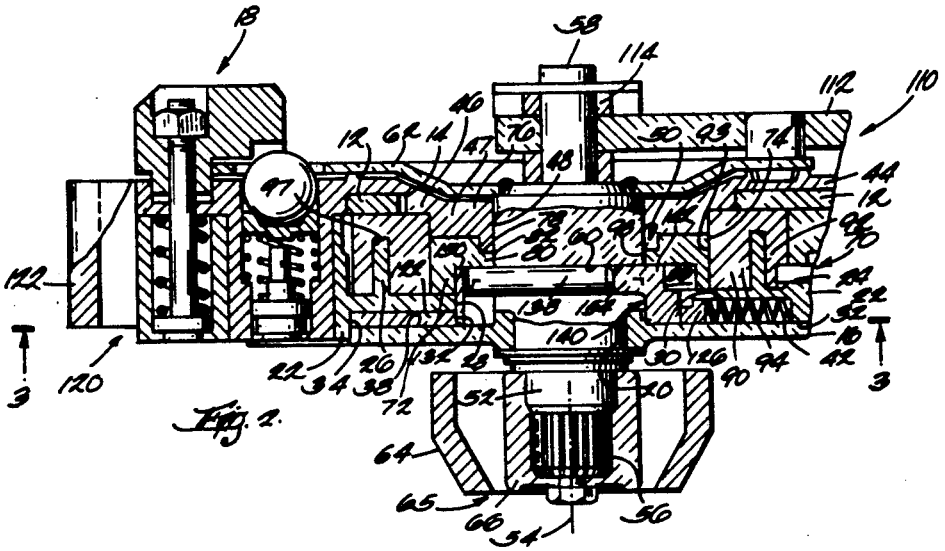
FIG. 2 is a view taken along line 2—2 in FIG. 1.

As shown in FIG. 2, the housing 22 includes an inner side 24 facing the support plate 12 and having thereon a generally cylindrical inner wall 26 which surrounds the bore 14 in the support plate 12. The housing 22 also has therein (FIGS. 2 and 4) a bore 28 which, when the housing 22 is mounted on the support plate 12, is generally coaxially aligned with the bore 14 in the support plate 12. The housing 22 also defines (FIGS. 2 and 4) a first recess 30 which extends generally radially from the bore 28.

The housing 22 also includes an outer side 32 facing the cover plate 12. The outer side 32 includes a wall 33 that defines (FIGS. 2 and 4) a second recess 34 which extends generally transversely of the bores 14, 28 and 20 extending respectively through the support plate 12, the housing 22, and the cover plate 16, and which (FIG. 4) defines an opening 36 on the left end (as seen in FIG. 4) of the housing 22 so that when the cover plate 16 and the housing 22 are in overlying relation, the cover plate 16 and housing 22 form (FIG. 2) therebetween a cavity 38. The wall 33 of the housing 22 also defines (FIG. 4) two slots 40 which extend generally parallel to the first recess 30 in the housing, and which are adapted to respectively house therein (FIG. 3) a pair of springs 42. The reason for the slots 40 and the springs 42 is explained below. The outer side 32 of the housing 22 also has thereon a generally rectangular projection 43 spaced inwardly from the wall 33.

The control 10 also includes (FIG. 2) a spacer 44 which is releasably fastened to the side of the support plate 12 opposite the housing 22 (the upper side in FIG. 2) by the fastening means 18 and which includes a generally circular portion 46 which extends into the bore 14 in the support plate 12. The portion 46 has extending therefrom a generally cylindrical shoulder 47 which extends past (below in FIG. 2) the support plate 12. The portion 47 has therein a bore 48 aligned with the bores 28, 14 and 20 in the housing 22, support plate 12 and cover plate 16 respectively. An annular step 50 extends from the shoulder 47 past the support plate 12 and surrounds the bore 48.

The control 10 also includes a drive shaft 52 which is supported by the cover plate 16 and by the spacer 44 for pivotal movement relative thereto about an axis 54 on which the centers of the bores 20 and 48 lie. The shaft 52 is movable between a full forward position, a forward clutch engaged position, a first or reference or neutral position, a rearward clutch engaged position, and a full rearward position As shown in FIG. 2, the shaft 52 is pivotally supported within the bore 20 in the cover plate 16 and within the bore 48 in the spacer 44. The shaft 52 has an externally splined first end 56 extending from the housing 22 and the cover plate 16 and a second, opposite end 58 extending outwardly of the other side of the support plate 12 and beyond the spacer 44. Intermediate the first and second ends 56 and 58, shaft 52 has therethrough a diametrically extending bore 60 which extends transversely of axis 54, the reasons for which are explained hereinafter.

The shaft 52 also has integrally connected thereto (see FIG. 2) a generally circular plate 62 that pivots in common with the shaft 52 and is separated from the support plate 12 by the spacer 44 so that the plate 62 and the spacer 44 cooperate to maintain the axial position of the shaft 52 relative to the housing 22 and the support plate 12.

The control 10 also comprises (FIG. 1) a control lever or handle 64 and means 65 for mounting the control lever 64 on the shaft 52 for common pivotal movement therewith. The control handle 64 is movable between full forward, forward clutch engaged, neutral (shown in FIG. 1), rearward clutch engaged and full rearward positions corresponding to the identically designated positions of the shaft 52. In the embodiment shown in FIG. 2, the means for mounting handle 64 includes (FIG. 2) an internally splined hub 66 mounted on the externally splined first end 56 of the shaft 52. Accordingly, pivotal movement of the handle 64 causes pivotal movement of the shaft 52.

The control 10 also comprises shift means 70 for operating a clutch (not shown). The shift means 70 includes (FIGS. 2 and 5) a shift cam 72 pivotally supported by the spacer 44 for rotation about the axis 54. The shift cam 72 is pivotally movable about the axis 54 between a full rearward position, a rearward clutch engaged position, a neutral position, a forward clutch engaged position and a full forward position.

As shown in FIG. 2, the shift cam 72 is positioned between the shoulder 47 of the spacer 44 and the inner side 24 of the housing 22 and has a generally circular outer wall 74 which is spaced inwardly of the annular inner wall 26 of the housing 22. The outer wall 74 has therein recesses **75*a* and 75*b*. As shown in FIG. 5, the recess 75*b* has a substantially greater arcuate extent than the recess 75*a*. The shift cam 72 also has a bottom surface 76 which defines a step 78 engaged with the step 50 in the shoulder 47 of the spacer to maintain the position of the shift cam 72. The shift cam 72 also has therethrough an axially extending bore 80 defined by (FIGS. 2 and 5) an inner wall 82 and is pivotally mounted on the shaft 52 in coaxial relation thereto. The inner wall 82 also defines (FIG. 5) a pair of diametrically opposed, radially extending recesses 84, 86 which are arranged about the bore 80 so that the recesses 84, 86 can be registered with the opposite ends of the diametrically extending bore 60 in the shaft 52. The recesses 84 and 86 are aligned with the diametrically extending bore 60 in the shaft 52, and with the first recess 30 in the housing 22, when the shift cam 72 is in the neutral position (FIG. 5) and when the shaft 52 is in the neutral position (FIG. 5**).

The shift means 70 also includes (FIGS. 2 and 5) a shift lever 90 supported by the support plate 12 and the housing 22 for pivotal movement relative thereto about the axis 54. The shift lever 90 has (FIG. 5) an outer portion 92 and has therethrough a bore 93 which is defined by an inner portion 94 and which surrounds the shift cam 72. The inner portion 94 has therein three recesses 95 adapted to house therein respective rollers 96. Two of the rollers 96 are normally received in the recess **75*b* in the shift cam 72, and one of the rollers 96 is normally received in the recess 75*a*, as shown in FIG. 5. The inner portion 94 is spaced from the outer portion 92 to define therebetween a generally annular space 97 which (FIG. 2) houses the annular inner wall 26 of the housing 22. The shift lever 90 is movable between a rearward clutch engaged position, a neutral position (FIG. 5), and a forward clutch engaged position. The shift lever 90 has thereon (FIG. 1) a pair of outwardly extending arms 98 each having therein a pair of apertures 99** each adapted to be connected to a clutch cable (not shown).

The shift means 70 also comprises (FIG. 5) means 100 for fixing the shift lever 90 to the shift cam 72 when the shift cam 72 is between the forward clutch-engaged position and the rearward clutch-engaged position, and for permitting rotation of the shift cam 72 relative to the shift lever 90 when the shift cam 72 is between the forward clutch engaged position and the full forward position and between the rearward clutch engaged position and the full rearward position While various suitable means can be employed, in the preferred embodiment, the means 100 for fixing the shift lever 90 includes the recesses **75*a* and 75*b* and the rollers 96** and is substantially identical to the arrangements disclosed in U.S. Pat. Nos. 4,648,497 and 4,951,520, both of which are incorporated herein by reference.

The control 10 also includes (FIG. 2) throttle means 110 operably connected to the shaft 52 and adapted to be operably connected to a throttle (not shown). The throttle means 110 includes a throttle cam or member 112 which is supported by the support plate 12 for translational movement relative thereto along a line 113 (FIG. 1) substantially perpendicular to and intersecting the axis 54; means (not shown) for causing translational movement of the throttle cam 112 relative to the support plate 12 in response to pivotal movement of the shaft 52 relative to the housing 22; a throttle lever 114 adapted to be connected to the throttle and supported by the support plate 12 for pivotal movement relative thereto about the axis 54; and means 116 for causing pivotal movement of the throttle lever 114 in response to translational movement of the throttle cam 112. While various arrangements could be employed, in the preferred embodiment, the throttle means 110 is substantially identical to the arrangement disclosed in the above-mentioned U.S. Pat. No. 4,951,520.

Thus, the control 10 includes shift means 70 operably connected to the shaft 52 and adapted to be operably connected to a clutch, and throttle means 110 operably connected to the shaft 52 and adapted to be operably connected to a throttle.

The control 10 also includes (see FIGS. 2 and 3) hand-operable warm-up means 120 movable transversely of the shaft 52 for permitting operation of the throttle means 110 without operation of the shift means 70. While various other arrangements could be successfully used, in the preferred embodiment, the warm-up means 120 includes a warm-up rod 504 which is slideably supported in the cavity 38 formed between the cover plate 16 and the housing 22. The warm-up rod 122 is supported for movement transverse to the axis 56 for operably connecting and disconnecting the shaft 52 and the shift means 70.

Figure 10:
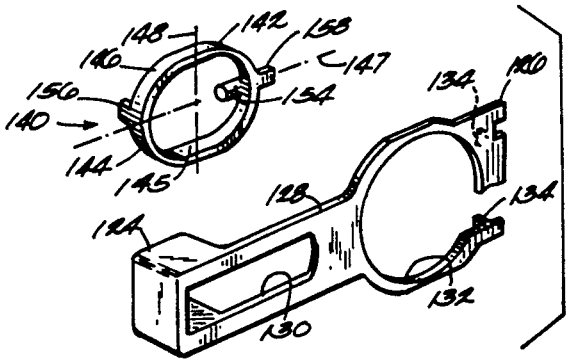
FIG. 10 is a perspective view, partially broken away for illustration, of the locking ring and the warm-up rod.
Figure 3:
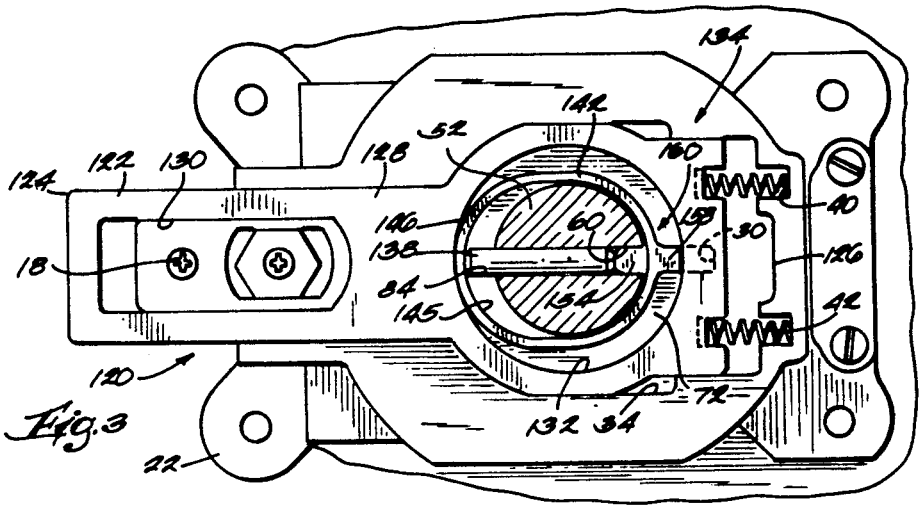
FIG. 3 is a view taken along line 3—3 in FIG. 2 and illustrating a housing, warm-up rod and locking ring.
Figure 8:
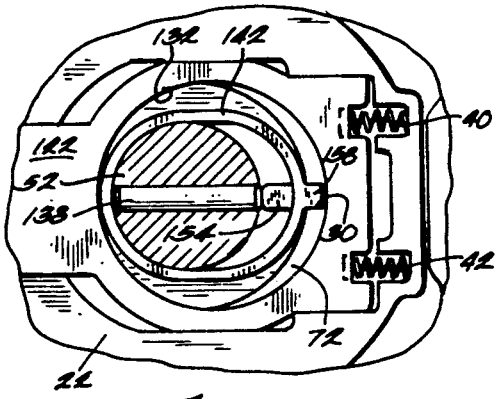
FIG. 8 is a view taken along line 8—8 in FIG. 7.
Figure 7:
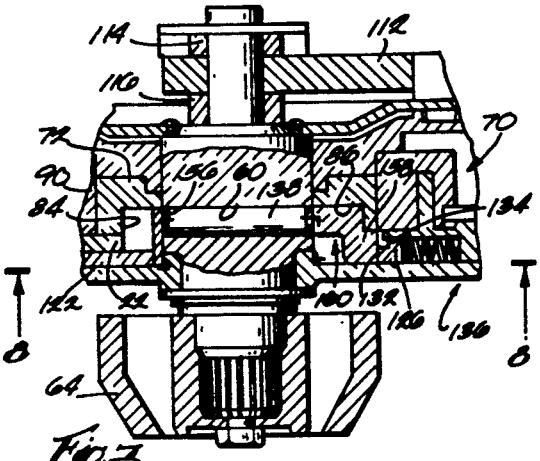
FIG. 7 is an enlarged view similar to FIG. 2 with the control in the warm-up position.

The warm-up rod 122 is configured to lie substantially within the second recess 34 in the housing 22 and is movable between a first, or normal operating position (FIGS. 2 and 3) and a second or warm-up position (FIGS. 7 and 8). As shown in FIG. 3, the warm-up rod 122 has a first end 124 which extends outwardly from the opening 36 in the housing 22 and a second end 126 which is housed in the cavity 38. As shown in FIG. 10, an intermediate portion 128 extends between the first and second ends 124, 126 and defines a slot 130 which extends transversely of the axis 54 and which (see FIG. 3) slidably receives the projection 43 on the housing 22. The intermediate portion 128 of the warm-up rod 122 also defines a generally cylindrical bore 132 which has a diameter substantially equal to the diameter of the bore 28 in the housing 22. As shown in FIGS. 2 and 3, when the warm-up rod 122 is in the first or normal position, the respective bores 28 and 132 are substantially coextensive with the exception of the first recess 30 in the housing 22, which recess 30 the second end 126 of the warm-up rod 122 overlies. When the warm-up rod 122 is moved from the normal position to the second warm-up position, or left to right in FIG. 3, the bore 132 in the warm-up rod 122 is displaced transversely from the bore 28 in the housing 22. When the warm-up rod 122 is in the second position (FIG. 8), the first recess 30 in the housing 22 is uncovered by the warm-up rod 122.

The warm-up rod 122 also includes, on the second end 126 thereof, a pair of tabs 134 (FIG. 10) which extend generally parallel to the axis 154 and which are adapted to be respectively housed in the slots 40 in the housing 22. As shown in FIG. 7, the tabs 134 extend into the slots 40 and, for reasons discussed below, engage the springs 42 which are located in the slots 40.

The warm-up means 120 also includes means 136 for biasing the warm-up rod 122 to the left as shown in FIG. 7 or toward the first or normal operating position. While various other constructions could be used, in the preferred embodiment, the means 136 for biasing the warm-up rod 122 includes (FIGS. 2 and 10) the tabs 134 on the warm-up rod 122 and the springs 42 housed in the slots 40. Engagement between the tabs 134 and the springs 42 biases the warm-up rod 122 toward its normal operating position, or to the left in FIG. 3.

The warm-up means 120 also includes (FIGS. 2 and 3) a first pin 138 which is slideably housed by the bore 60 in the shaft 52. As illustrated in FIG. 7, the first pin 138 has a length which is substantially equal to the diameter of the shaft 52 at the point where the bore 60 extends through the shaft 52 so that the first pin 138 can be substantially housed within the bore 60, as shown in FIGS. 7 and 8. The first pin 138 is movable in the bore 60 so that (FIGS. 2 and 3) a portion of the pin 138 can be moved into the second recess 84 in the shift cam 72 when the shaft 52 is in the neutral position and when the shift cam 72 is in the neutral position. As explained below, subsequent rotation of the shaft 52 from the neutral position causes rotation of the shift cam 72 with the shaft 52 due to engagement of the first pin 138 with both the shaft 52 and the shift cam 72.

The warm-up means 120 also includes locking means 140 for fixing the shift cam 72 to the shaft 52 and for affording rotation of the shift cam 72 relative to the housing 22 when the warm-up rod 122 is in the normal position, and for selectively and alternatively fixing the shift cam 72 to the housing 22 and for affording rotation of the shaft 52 relative to the shift cam 72 when the warm-up rod 122 is in the warm-up position. While various other arrangements could be used, in the preferred embodiment, the locking means 140 includes (FIGS. 2, 3 and 10) a locking ring or member 142 which is supported between the shift cam 72 and the cover plate 16 and which is located within the bores 28 and 132 in the housing 22 and in the warm-up rod 122 respectively.

The locking ring 142, as shown in FIG. 10, includes a generally elliptical band 144 having inner and outer walls or surfaces 145 and 146, having a major axis 147 and a minor axis 148. The locking ring 142 (FIG. 2) is in surrounding relation to the shaft 52 and is positioned on the shift cam 72 so that the inner surface 150 of the band 144 lies on the outer surface of the shift cam 72 and the outer surface 152 of the band 144 extends through the bore 28 in the housing 22 and into the cavity 38 defined by the housing 22 and the cover plate 16. The locking ring 142 includes (FIGS. 2 and 10) a second pin 154 which is disposed on the lower surface 150 of the band 144 at one end of the band 144 and which extends inwardly of the band 144 and generally along the major axis 147. The second pin 154 is housed in the third recess 86 of the shift cam 72 and has a diameter which (FIG. 3) affords movement of the second pin 154 into the bore 60 in the shaft 52 when the recesses 84, 86 in the shift cam 72 are aligned with the bore 60 in the shaft 52. The locking ring 142 also includes (see FIG. 10) a first tab 156 which extends parallel to the axis 56 from the inner surface 150 of the band 144, which is coextensive with the inner and outer walls 145 and 146 of the band 144 and which is disposed on the end of the band 144 opposite the second pin 154. When the locking ring 142 is assembled in surrounding relation to the shaft 52, the first tab 156 extends into the second recess 84 in the shift cam 72, as shown in FIG. 7. For reasons discussed below, the distance between the end of the second pin 154 and the first tab 156 is substantially equal to the length of the first pin 138.

The locking ring 142 also includes (see FIG. 10) an outwardly extending second tab 158 which is disposed on the same end of the band 144 as the second pin 154 and which extends outwardly from the outer wall 146 of the band 144 along the major axis 147. When the locking ring 142 is in surrounding relation to the shaft 52, and when the shaft 52 is in the neutral position, the second tab 158 aligns with the first recess 30 in the housing 22.

As mentioned above, the inner surface 150 of the band 144 lies against the shift cam 72 and the outer surface 152 of the band 144 extends into the cavity 38 defined by the housing 22 and the cover plate 16 so that, as shown in FIG. 3, the outer wall 146 of the locking ring 142, including the second tab 158, is located within the circular bore 132 in the intermediate portion 128 of the warm-up rod 122. As illustrated in FIG. 4, the dimensions of the locking ring 142 along the major axis 147 of the elliptical locking ring 142 are sufficiently large to provide clearance between the locking ring 142 and the outer diameter of the shaft 52 so that the locking ring 142 is movable transversely relative to the shaft between a first or normal operating position (FIG. 3) wherein the second pin 154 on the locking ring 142 is housed in the radially extending bore 60 in the shaft 52, and a second or warm-up position (FIG. 7) wherein the second pin 154 is housed in the third recess 86 in the shift cam 72 and is outside the radially extending bore 60 in the shaft 52, and wherein the second tab 158 is housed in the first recess 30 in the housing 22.

The control 10 also includes means 159 for moving the locking ring 142 in response to movement of the warm-up rod 122. While various other constructions could be employed in the prefered embodiment, the means 159 for moving the locking ring 142 in response to movement of warm-up rod 122 includes bore 132 in the warm-up rod 122 which engages the outer surface 146 of the locking ring 142.

The warm-up means 120 also includes means 160 for moving a portion of the first pin 138 from the bore 60 in the shaft 52 and into the second recess 84 in the shift cam 72 (see FIG. 3) when the warm-up rod 122 is in the normal position and for moving the portion of the pin 138 out of the second recess 84 and into the bore 60 (see FIG. 8) when the warm-up rod 122 is in the warm-up position and when the shaft 52 and the shift cam 72 are in the neutral position. While various other constructions could be used, in the preferred embodiment, the means 160 for moving the pin 138 includes the second pin 154 on the locking ring 142. The pin 154 is movable into the bore 60 in the shaft 52 and is engageable with the first pin 138 to move a portion of the first pin 138 from the bore 60 and into the second recess 84. The means 160 also includes the first tab 156 on the locking ring 142. The tab 156 extends into the second recess 84 and is engageable with the first pin 138 to move the first pin 138 out of the second recess 84 and into the bore 60 when the shaft 52 and the shift cam 72 are in the neutral positions.

Figure 6:
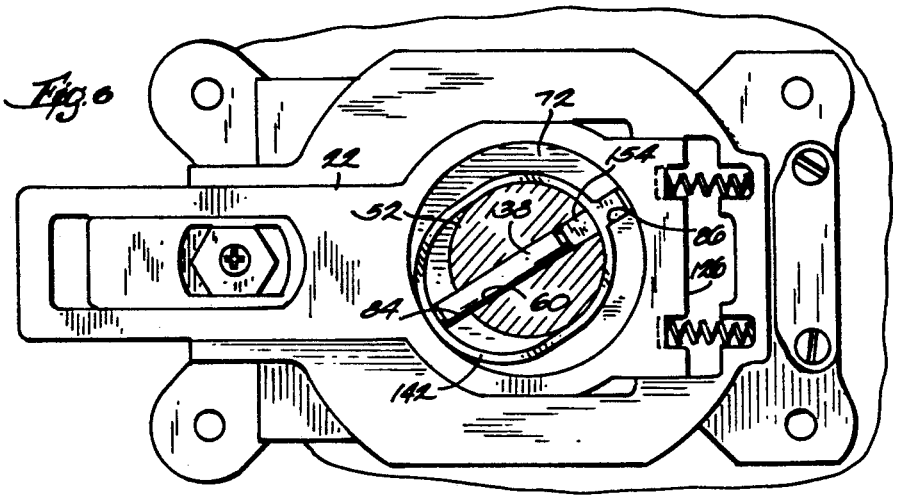
FIG. 6 is a view similar to FIG. 3 with the shaft in a rotated position.

As illustrated in FIG. 6, and as explained below, when the locking ring 142 and the warm-up rod 122 are in their normal positions, the locking ring 142 is rotatable with the shift cam 72 relative to the housing 22 due to engagement between the second pin 154 and the bore 60 in the shaft 52, between the second pin 154 and the third recess 86 in the shift cam, and between the tab 156 and the recess 84 in the shift cam 72.

The control 10 also includes, however, means 162 for preventing rotation of the shift cam 72 relative to the housing 22 and from the neutral position when the warm-up rod 122 and the locking ring 142 are in their warm-up positions. While various other constructions could be employed, in the preferred embodiment, the means 162 for preventing rotation of the shift cam 72 includes, on the locking ring 142, the second tab 158 which engages the first recess 30 in the housing 22 when the locking ring 142 is in the warm-up position and when the shift cam 72 is in the neutral position, the second pin 154 which engages the third recess 86 in the shift cam 72, and the first tab 156 which engages the second recess 84 in the shift cam 72. The locking means 140 thus also includes means for fixing the shift cam 72 to the shaft 52 and affording rotation of the shift cam 72 relative to the housing 22 when the locking ring 142 is in its normal position, and for alternatively fixing the shift cam 72 to the housing 22 for affording rotation of the shaft 52 relative to the shift cam 72 when the warm-up rod 122 is in its warm-up position.

The control 10 operates as follows: When the warm-up rod 122 is in its normal operating position (FIGS. 2–6), movement of the handle 64 from its neutral position to its forward clutch engaging position operates to move the shift cam 72 (due to engagement between the first pin 138, the shaft 52 and the second recess 84 in the shift cam 72 and engagement between the pin 154, the shaft 52 and recess 86 in the shift cam 72) to its forward clutch engaged position and to thereby move the shift lever 90 to its forward clutch engaged position. This movement shifts the clutch into forward. Movement of the handle 64 to its forward clutch engaged position does not move the throttle lever 114 and therefore does not open the throttle. Movement of the handle 64 from its forward clutch engaged position to its full forward position operates to move the shaft 52 to its full forward position and to move the throttle lever 114 to its throttle open position. The shift lever 90 does not move during movement of the handle 64 from its forward clutch engaged position to its full forward position. Thus, movement of the handle 64 from its forward clutch engaged position to its full forward position opens the throttle.

In a similar manner, movement of the handle 64 from its neutral position to its rearward clutch-engaged position shifts the clutch into reverse but does not open the throttle, and movement of the handle 64 from its rearward clutch engaged position to its full rearward position opens the throttle.

In order to warm up the engine (not shown) the operator pushes the warm-up rod 122 transversely of the axis 54 from its normal operating position, and against the springs 42, to the warm-up position (FIGS. 7–9) when the handle 64 is in its neutral position (misalignment of the recesses 84, 86 in the shift cam 72 with the first recess 30 in the housing 20 prevents movement of the locking ring 142 into engagement with the housing 22, prevents the pin 138 from moving radially outwardly from the shaft 60 and into engagement with the recess 86 in the shift cam 72, and thereby prevents the operator from moving the warm-up rod 122 from the normal position to the warm-up position, or left to right in FIG. 3, when the handle 64 is not in its neutral position). Movement of the warm-up rod 122 from its normal operating position to its warm-up position moves the locking ring 142 from its normal position to its warm-up position, as described above, to prevent pivotal movement of the shift cam 72 relative to the housing 22 and to permit pivotal movement of the shaft 52 relative to the housing 22. Accordingly, when the warm-up rod 122 is pushed inwardly of the control 10 by the operator, movement of the handle 64 from its neutral position to its forward clutch-engaged position does not shift the clutch into forward. Further movement of the handle 64 from its forward clutch engaged position to its full forward position opens the throttle. Thus, when the warm-up rod 122 is moved into its warm-up position, the operator can advance the throttle without shifting the clutch.

When the engine is sufficiently warmed up, the operator can return the handle 64 to its neutral position. When the handle 64 is returned to its neutral position, the springs 42 will bias the warm-up rod 122 outwardly toward its normal operating position and will reengage the locking ring 142 with the shaft 52, and the pin 138 with the shift cam 72, for normal engine operation.

Figure 11:
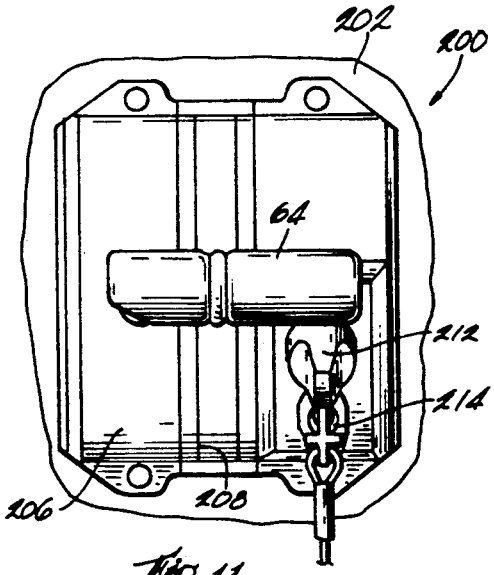
FIG. 11 is a top view of an alternative embodiment of a single-lever control embodying various features of the invention.
Figure 12:
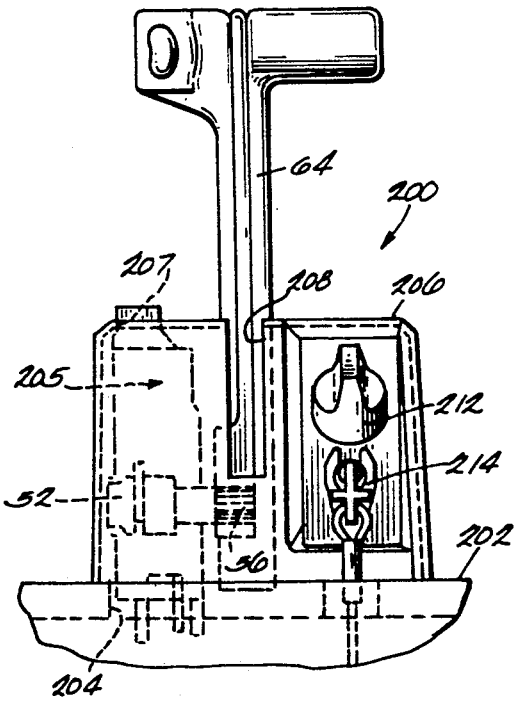
FIG. 12 is a view of the control illustrated in FIG. 11.

FIGS. 11 and 12 illustrate a single binnacle control 200 which is first alternative embodiment of the invention and which is mounted on a horizontally extending mounting surface 202 having therein a hole 204. The binnacle control 200 includes a single lever control 205 mounted on the surface 202 by any suitable means. Except as described below, the control 205 is substantially identical to the above-described control 10, and common elements have been given the same reference numerals. The control 205 includes a shaft 52 having a splined end 56, and the binnacle control 200 includes a binnacle cover which overlies the hole 204 in the mounting surface 202. The cover 206 has an upper portion having therein a hole 207 and having therein a slot 208 which extends generally transverse to the shaft 52. The single lever control 205 also includes a control lever 64 which is supported by the splined end 56 of the shaft 52 and which is mounted centrally of the cover 206 and extends through the slot 208. The binnacle control 200 also includes an ignition switch 212 and an ignition cut-out switch 214, both of which are mounted on the binnacle cover 206. A suitable construction for the switches 212 and 214 is disclosed in application Ser. No. 494,789 which was filed on Mar. 12, 1990 and which is incorporated herein by reference.

Figure 13:
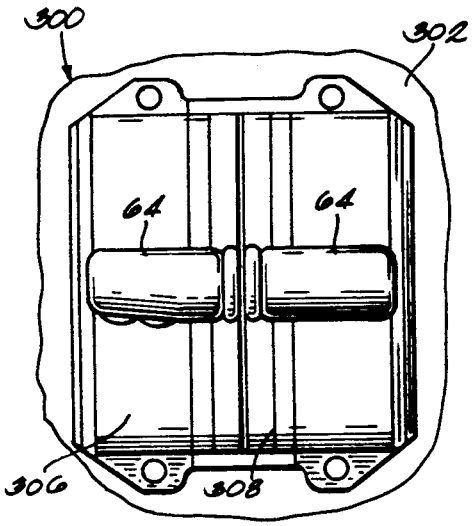
FIG. 13 is a top view of an alternative embodiment of a single-lever control embodying various features of the invention.
Figure 14:
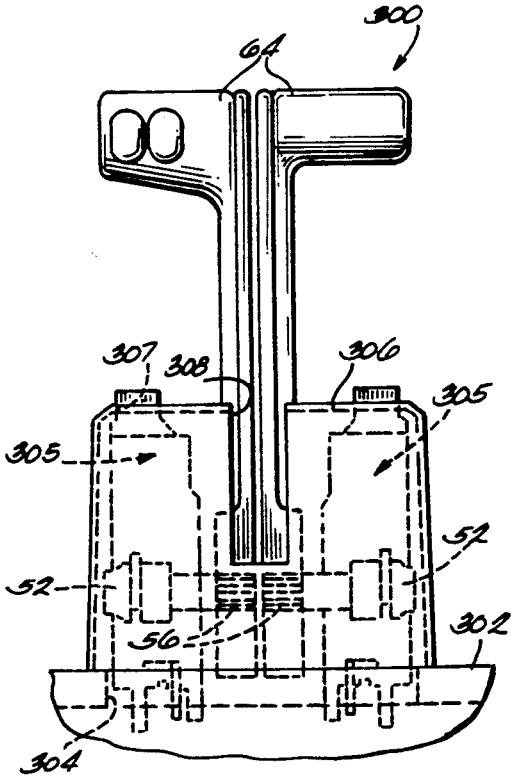
FIG. 14 is a view of the control illustrated in FIG. 13.

FIGS. 13 and 14 illustrate a dual binnacle control 300 which is a second alternative embodiment of the invention. Like the single binnacle control 200, the dual binnacle control 300 is mounted on a horizontally extending mounting surface 302 which has therein a hole 304. The dual binnacle control includes a pair of single lever controls 305 that are substantially identical to the control 205. The single lever controls 305 include respective shafts 52 which are aligned in end-to-end relation, each having a splined end 56. The dual binnacle control also includes a binnacle housing 306 which overlies the hole 304 in the mounting surface 302 and which has an upper portion having therein a hole 307 and a slot 308 extending generally transversely to the shafts 52. The dual binnacle control also includes a pair of control levers 64, each of which is supported by the splined end 56 of a respective shaft 52 and which extend through the slot 308 in the binnacle housing 306.

Figure 15:
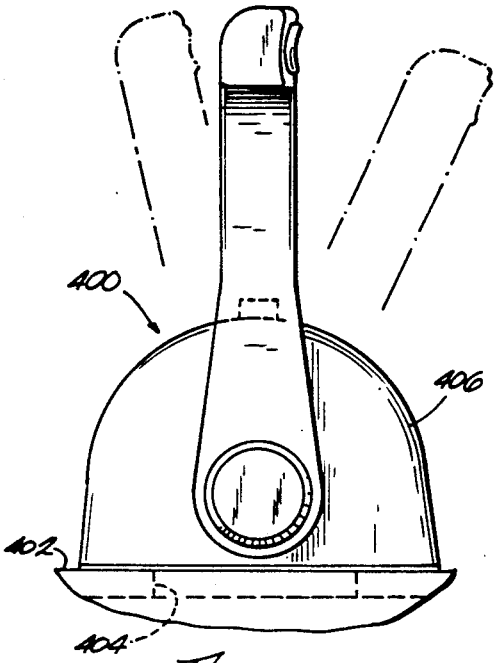
FIG. 15 is a side view of an alternative embodiment of a single lever control embodying various features of the invention.
Figure 16:
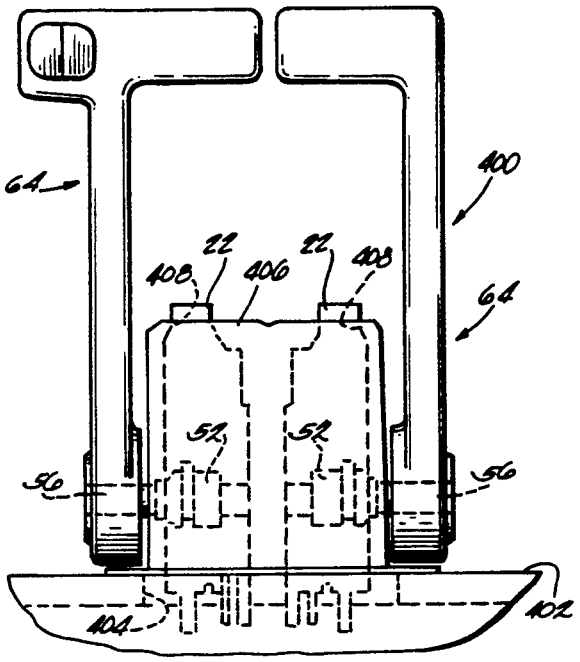
FIG. 16 is a view of the control illustrated in FIG. 15.
Figure 17:
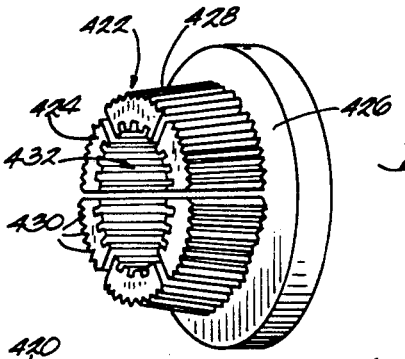
FIG. 17 is an enlarged perspective view of a portion of an alternative embodiment of a single lever control embodying various features of the invention.
Figure 18:
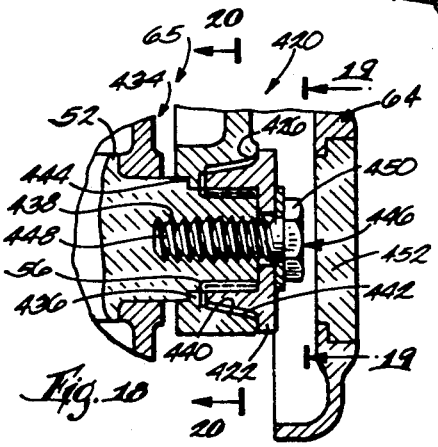
FIG. 18 is a cross-sectional view of an alternative embodiment of a single lever control embodying various features of the invention.
Figure 19:
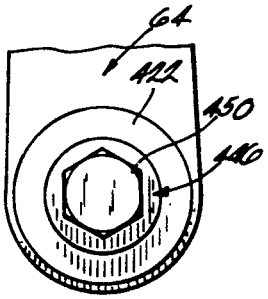
FIG. 19 is a view taken along line 19—19 in FIG. 18.
Figure 20:
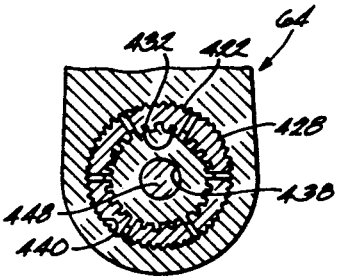
FIG. 20 is a view taken along line 20—20 in FIG. 18.

FIGS. 15 and 16 illustrate a dual binnacle control 400 which is a third alternative embodiment of the invention. Like the dual binnacle control 300, the dual binnacle control 400 is mounted on a horizontally extending mounting surface 402 which has therein a hole 404. The dual binnacle control includes a pair of single lever controls 405 that are substantially identical to the controls 305. The single lever controls 405 include respective shafts 52 which are aligned in end-to-end relation, each having a splined outer end 56 which extends through the respective side of the binnacle housing 406. The dual binnacle control 400 also includes a binnacle housing 406 which has an upper portion having therein a pair of holes 408 which house the ends of the warm-up rods 22. The dual binnacle control also includes a pair of control levers 64, each of which are supported by the splined end 56 of a respective shaft 52.

An alternative means 65 for mounting the control lever 64 on the shaft 52 is illustrated in FIGS. 17–20. In the alternative embodiment, the means 65 for mounting the control lever 64 on the shaft 52 includes adjustable means 420 for mounting the control lever 64 on the shaft 52 for rotation of the control lever 64 relative to the shaft 52 and alternatively for common rotation therewith. While various suitable constructions could be successfully employed, in the preferred embodiment, the adjustable means 420 includes a collet 422 (FIGS. 17 and 18) having first and second, or inner and outer ends 424, 426 and a generally tapered or frustoconical outer surface 428 extending from the first end 424. In the illustrated embodiment (FIG. 18), the outer end 426 of the collet 422 has a greater outer diameter than the inner end 424. For reasons discussed below, the outer surface 428 of the collet 422 includes a plurality of externally extending ribs or serrations 430 which extend substantially the entire length (left to right in FIG. 18) of the outer surface 428. The collet 422 also includes (FIG. 18) a bore 432 which extends from the inner end 424, and which is internally splined. The collet 422, by means of the bore 432, houses the externally splined end 56 of the shaft 52 and is, by means of engagement of the internally and externally splined portions engaged with the shaft 52 for common rotation therewith. The shaft 52 and the collet 42 constitute rotatable shaft means 434. Preferably, and for reasons discussed below, the collet 422 is made of a relatively hard material such as stainless steel powdered metal.

The adjustable means 420 also includes, on the shaft, a radially outwardly extending step or shoulder 436 adjacent the splined portion, and a bore 438 extending from the first end 56.

The adjustable means 420 also includes, on the control lever 64, a wall 440 (FIGS. 18 and 20) which defines a generally frustoconical bore 442 and which surrounds the serrated outer surface 428 of the collet 422. The wall 440 also defines a radially inwardly extending flange 444 which engages the shoulder 436 on the shaft 52. Preferably, the wall 440 is made of a relatively soft material compared to the material used for the collet 422. One suitable material for the handle is ZAMAK 3, an alloy comprising aluminum and zinc.

The adjustable means 420 also includes means 446 for causing engagement of the outer surface 428 of the collet 422 and the wall 440. While various other suitable means could be employed, in the preferred embodiment, such means 446 includes a bolt 448 which is threadedly engaged with the bore 438 in the shaft 52, which extends through the bore 432 in the collet 422, and which has a head 450 which engages the outer end 426 of the collet 422.

The adjustable means 420 is assembled as follows. The serrated portion of the collet is placed into the frustoconical bore 442 in the control lever 64 in a loose manner so that the collet 422 can be rotated relative to the control lever 64. The length of the collet 422 is such that the serrated outer surface 428 of the collet 422 engages the wall 440 of the control lever 64 before the inner end 424 of the collet 422 engages the radially inwardly extending flange 444 on the control lever 64. Once loosely assembled, the control lever 64 and the collet 422 are placed on the splined end 56 of the shaft 52 such that the flange 444 on the control handle 64 engages the shoulder 436 on the shaft 52, and such that the internally and externally splined portions of the collet 422 and the shaft 52 respectively engage. The bolt 448 is then threadedly engaged with the bore 438 in the shaft 52 to hold the collet 422 and control lever 64 on the shaft 52. Due to engagement of the internally and externally splined portions, the collet 422 is rotationally fixed to the shaft 52, however, the control lever 64 can be rotated with respect to the collet 422 and the shaft 52. The control lever 64 is then adjusted to any desired rotational position. For example, in the dual binnacle control 400, each control lever 64 can be aligned to the same angular position. Once the control levers 64 are aligned, the bolt 448 is tightened to move the outer, serrated surface 428 of the relatively hard collet 422 into engagement with wall 440 in the relatively soft control lever 64. Engagement of the relatively hard serrated surface 428 with the relatively soft frustoconical wall 440 plastically deforms the wall 440 and fixes the collet 422 to the control lever 64 such that the collet 422 and the control lever 64 rotate in common. The control thus also provides locking means for mounting the control lever 64 on the shaft 52 including means for plastically deforming one of the control lever 64 and the shaft means 434. Once the bolt 448 is advanced to provide sufficient tortional resistance between the collet 422 and the control lever 64, a plastic cap 452 can be placed over the head 450 of the bolt 448.

FIGS. 21–24 illustrate a single lever control 500 which is a fourth alternative embodiment of the invention. The single lever control 500 includes alternative warm-up means 520 for permitting operation of the throttle means 110 without operation of the shift means 70.

The warm-up means 520 includes a warm-up rod or member 522 which is slidably supported in the cavity 38 formed between the cover plate 16 and the housing 22. The warm-up rod 522 is similar to warm-up rod 122 and includes opposite ends 524 and 526, intermediate portion 528 which defines a cylindrical bore 532 and tabs 534 extending into the slots 40 in the housing 22. Similar to warm-up rod 122, warm-up rod 522 is supported for movement transverse to axis 56 for operably connecting and disconnecting the shaft 52 and the shift means 70. Furthermore, the warm-up rod 522 includes a tang portion 535 which extends from the intermediate portion 538 of the warm-up rod 522 and into the bore 532 in a direction generally parallel to the slots 40 in the housing 22 and toward the shaft 52. In the illustrated construction, the tang 535 is located on the side of the bore 532 closest to the end 524 of warm-up rod 522 extending from housing 22 and overlies recess 84 in the shift cam 72 when the shift cam 72 is in the neutral position.

Figure 21:
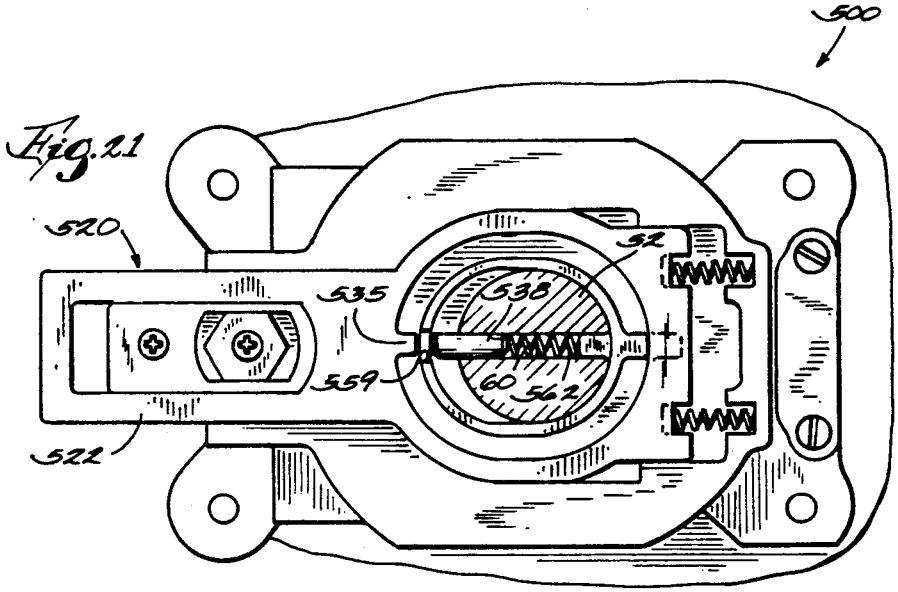
FIG. 21 is a view similar to FIG. 3 illustrating an alternative embodiment of a single lever control embodying various features of the invention.
Figure 24:
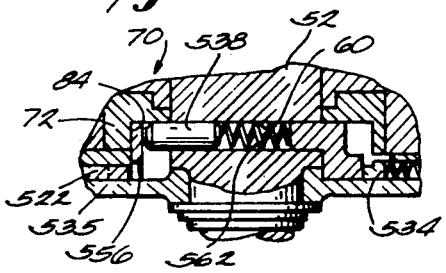
FIG. 24 is a view taken along line 24—24 in FIG. 23.

The warm-up means 520 also includes a first pin 538 which is slidably housed by the bore 60 in the shaft 52. As illustrated in FIGS. 21 and 24, the first pin 538 has a length which is approximately one half of the diameter of the shaft 52 so that the first pin 538 can be substantially housed within the bore 60 and so that, like the first pin 138, the first pin 538 is free of projection beyond the shaft 52. The first pin 538 is movable longitudinally of the bore 60, however, so that a portion of the first pin 538 can be moved into the second recess 84 in the shift cam 72 when the shaft 52 is in the neutral position and when the shift cam 72 is in the neutral position.

The warm-up means 520 also includes locking means for fixing the shift cam 72 to the shaft 52 and for affording rotation of the shift cam 72 relative to the housing 22 when the warm-up rod 522 is in the normal position, and for selectively and alternatively fixing the shift cam 72 to the housing 22 and for affording rotation of the shaft 52 relative to the shift cam 72 when the warm-up rod 522 is in the warm-up position. While various other arrangements could be used, in the embodiment illustrated in FIGS. 21–24, the locking means includes a locking ring 542 which is similar to locking ring 142 and which includes an eliptical band 544, a second pin 554 engagable with the first pin 538 and adapted to be substantially housed by the bore 60, and first and second tabs 556 and 558 which are respectively similar to the first and second tabs 156 and 158.

Locking ring 542 is engaged with the third recess 86 of the shift cam 72 so that the locking ring 542 and shift cam 72 are fixed for common rotation about axis 54 but so that the locking ring 542 is moveable transversely of axis 52 relative to shift cam 72. The locking ring 542 is further provided with a recess, or notch 559, in the band 544 adjacent tab 556. The recess 559 is aligned with the tang 535 on the warm-up rod 122 when the shift cam 72 and shaft 52 are in the neutral position. As with the first alternative embodiment disclosed above, movement of the warm-up rod 522 to the warm-up position moves the locking ring 542 from its normal operating position towards its warm-up position wherein the tab 558 moves into engagement with recess 30 of the housing. Clearance between the tang 535 and the band 544 is provided, however, so that the locking ring 542 is free to rotate with the shaft 52 relative to the warm-up rod 522 when the locking ring 542 and warm-up rod 522 are in their normal operating positions.

Figure 23:
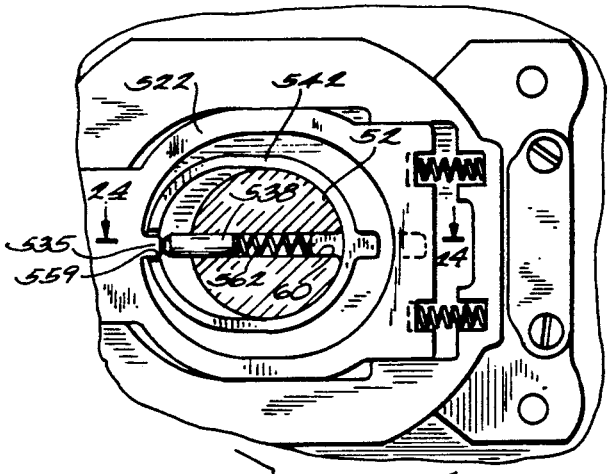
FIG. 23 is an enlarged view of a portion of the control illustrated in FIG. 21 with the warm-up rod engaged with the locking ring.
Figure 22:
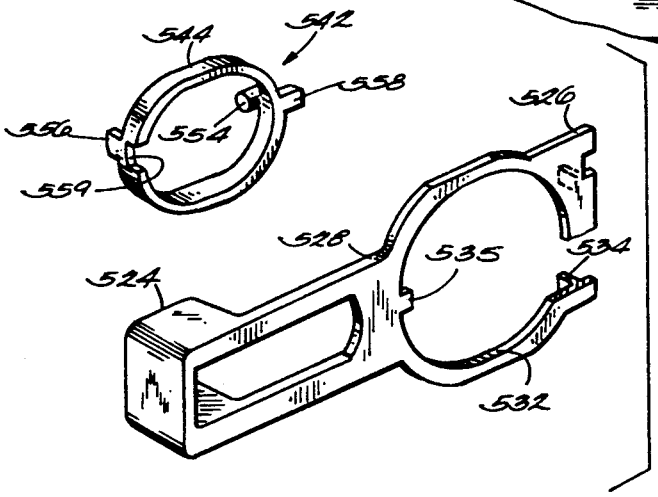
FIG. 22 is a view similar to FIG. 10 of the control illustrated in FIG. 21.

As illustrated in FIG. 23, when the warm-up rod 522 is moved from its normal operating position toward the warm-up position (to the right in FIG. 23), the tang 535 moves with, and engages, the notch or recess 559 in the locking ring 542 before the bore 532 of the warm-up rod 522 engages the outer surface of the band 544. Thus, when the warm-up rod 522 is not in its normal position, the locking ring 542 is engaged with the warm-up rod 522 and, therefore, is not free to rotate relative to either the warm-up rod 522 or housing 22 about axis 54. Also, when the locking ring 542 is between its normal operating and warm-up positions, the locking ring 542 and, therefore, the shift cam 72, are prevented from rotating relative to the warm-up rod 122 and also relative to the housing 22.

The warm-up means 520 thus also provides releasable locking means for selectively affording rotation of the locking ring 542 and shift cam 72 relative to the warm-up rod 522 and housing 22 when the warm-up rod 522 is in the normal position to permit clutch actuation and alternatively for preventing rotation of the locking ring 542 and shift cam 72 relative to the warm-up rod 522 when the warm-up rod 522 is not in the normal operating position, and when the warm-up rod 522 and locking ring 542 is intermediate the normal operating and warm-up positions.

The warm-up means 520 prevents rotation of the locking ring 542 and shift cam 72 relative to the warm-up rod 522 by both engagement of the tang 535 and notch 559 and the second tab 558 and recess 30 in the housing 22. The control 10 is also operable, however, with warm-up means providing engagment only between the locking ring 142 and housing 22, as with the alternative embodiment of warm-up means 120, or with warm-up means (not shown) providing engagement only between the locking ring 542 and warm-up rod 22 (and not between locking ring 542 and housing 22) when the warm-up rod 522 and locking ring 542 are not in the normal operating position.

The warm-up means 520 illustrated in FIGS. 21–24 also includes alternative means 160 for moving a portion of the first pin 538 from the bore 60 in the shaft 52 and into the second recess 84 in the shift cam 72 when the warm-up rod 522 is in the normal position and for moving the portion of the first pin 538 out of the second recess 84 and into the bore 60 when the warm-up rod 122 is in the warm-up position and when the shaft 52 and the shift cam 72 are in the neutral position.

In particular, the illustrated alternative embodiment of the means 160 includes means for immediately effecting movement of pin 538 in response to movement of locking ring 542 transversely of shaft 52. While various other constructions could be successfully employed, the means for immediately effecting movement of the first pin 538 includes means for eliminating lost motion between the locking ring 542 and the first pin 538 when the locking ring 542 moves the first pin 538 into and out of the the bore 60 in the shaft 52. In the illustrated embodiment, the means 561 for eliminating lost motion between the first pin 538 and the locking ring 542 includes means for maintaining contact between the first pin 538 and the locking ring 542. Preferably, the means for maintaining contact between the first pin 538 and the locking 542 is in the form of a compression spring 562 which is located between the second pin 554 and the second tab 556 on the locking ring 542 for biasing the pin 538 toward pin 554. The spring 562 engages the first pin 538 and the second pin 554 to bias the first pin 558 into engagement with the second tab 556. Engagement of the spring 562 and the first pin 538 maintains contact between the second pin 538 and the second tab 556 of the locking ring 542 and eliminates lost motion between the locking ring 542 and the first pin 538 which can be caused by manufacturing tolerances.

Various features of the invention are set forth in the following claims.

I claim:

1. A single lever control for operating a throttle and a clutch, said control comprising a housing, a shaft pivotally supported by said housing, shift means operably connected to said shaft, adapted to actuate the clutch and including a shift actuating member pivotably supported by said housing to effect clutch actuation relative to a neutral position, a throttle actuating member operably connected to the shaft and adapted to be operably connected to the throttle, warm-up means for permitting operation of said throttle means without operation of said shift means and including a warm-up member movable transversely of said shaft between a first position and a second position, and releasable locking means operable selectively and alternatively for affording rotation of said shift actuating member relative to said warm-up member when said warm-up member is in said first position to permit clutch actuation and for preventing rotation of said shift actuating member relative to said neutral position when said warm-up member is not in said first position.

2. A single lever control as set forth in claim 1 wherein said locking means includes means for fixing said shift actuating member to said shaft to permit clutch actuation and alternatively for fixing said shift actuating member to said warm-up member and for affording rotation of said shaft relative to said shift actuating member.

3. A single lever control as set forth in claim 2 wherein said locking means includes means for fixing said shift actuating member to said shaft to permit clutch actuation and alternatively for fixing said shift actuating member to said housing and for affording rotation of said shaft relative to said shift actuating member to prevent clutch actuation.

4. A single lever control as set forth in claim 1 wherein said locking means includes means for fixing said shift, actuating member to said shaft to permit clutch actuation and alternatively for fixing said shift actuating member to said housing and to said warm-up member and for affording rotation of said shaft relative to said shaft to prevent clutch actuation.

5. A single lever control as set forth in claim 1 wherein said locking means includes a locking member which is supported by said housing for movement between a first position and a second position and which is engaged with said shift actuating member for common pivotal movement therewith, and wherein said warm-up means includes means for moving said locking member between said first and second positions.

6. A single lever control as set forth in claim 5 wherein said warm-up member has a tang portion extending toward said locking member, and wherein said locking member has therein a recess adapted to receive said tang portion of said warm-up member when said warm-up member moves from said first position toward said second position.

7. A single lever control for operating a throttle and a clutch, said control comprising a housing, a shaft supported by said housing for pivotal movement about an axis, shift means operably connected to the shaft and adapted to actuate the clutch, throttle means operably connected to said shaft and adapted to be operably connected to the throttle, and warm-up means for permitting operation of said throttle means without operation of said shift means and including a warm-up member movable transversely of said axis, a locking member supported by said housing for movement between a first position wherein said locking member is engaged with said shaft for common rotation therewith relative to said warm-up member to permit shift actuation and a second position wherein said locking member is rotatable relative to said shaft, and selectively releaseable locking means for preventing rotation of said locking member relative to said warm-up member to prevent shift actuation when said locking member is intermediate said first and second positions.

8. A control as set forth in claim 7 wherein said warm-up means includes means for moving said locking member between said first position and said second position.

9. A control as set forth in claim 8 wherein said warm-up member is moveable between a first position and a second position and includes a portion selectively engageable with said locking member, and wherein said means for moving said locking member includes said engagement between said portion of said warm-up member and said locking member.

10. A control as set forth in claim 9 wherein said portion of said warm-up member includes a tang extending toward said locking member, wherein said locking member has therein a recess adapted to receive and engage said tang, and wherein said means for preventing rotation of said locking member includes said engagement of said tang and said recess in said locking member.

11. A control as set forth in claim 10 wherein said recess in said locking member receives said tang before said portion of said warm-up member engages said locking member.

12. A control as set forth in claim 7 wherein said locking means includes means for preventing rotation of said locking member relative to said warm-up member to prevent shift actuation when said locking member is in said second position.

13. A single lever control for operating a throttle and a clutch, said control comprising a housing, a shaft supported by said housing for pivotal movement about an axis and having therethrough a bore extending transversely to said axis, shift means operably connected to said shaft and adapted to be operably connected to the clutch to effect movement thereof relative to a neutral position, throttle means operably connected to said shaft and adapted to be operably connected to the throttle, warm-up means for permitting operation of said throttle means without operation of said shift means and including a member supported by said housing for movement between a first position and a second position, a pin housed in said bore and moveable longitudinally thereof in response to movement of said member between a first position wherein a portion of said pin extends from said bore and a second position wherein said pin is substantially free of projection beyond said shaft, means for immediately effecting motion of said pin longitudinally of said bore in response to movement of said locking member between said first and second positions, and means for preventing rotation of said shift means relative to the neutral position when said pin is substantially free of projection beyond said bore of said shaft.

14. A control as set forth in claim 13 wherein said means for effecting immediate motion of said pin in response to movement of said locking member includes means for eliminating lost motion between said locking member and said pin.

15. A control as set forth in claim 14 wherein said means on said locking member for moving said pin includes a first portion and a second portion spaced from said first portion, and wherein said pin is located between said first and second portions.

16. A control as set forth in claim 15 wherein said means for eliminating lost motion between said locking member and said pin includes means for maintaining contact between said pin and one of said first and second portions of said locking member.

17. A control as set forth in claim 16 wherein said means for maintaining contact between said pin and one of said first and second portions includes means for biasing said pin into contact with said one of said first and second portions.

18. A single lever control for operating a throttle and a clutch, said control comprising a housing, a shaft pivotally supported by said housing, shift means operably connected to said shaft for selectively actuating the clutch and including a shift actuating member supported by said housing for movement relative thereto to effect clutch actuation, a throttle control lever operably connected to the shaft and adapted to be operably connected to the throttle, and warm-up means for permitting operation of the throttle without operation of said shift means and including a warm-up member movable transversely of said shaft between a first position and a second position, and releasable locking means operable alternatively and selectively for connecting said control lever and said shift actuating member to permit clutch actuation when said warm-up member is in said first position and for disconnecting said control lever and said shift actuating member and preventing movement of said shift actuating member relative to said housing when said warm-up member is not in said first position.

19. A single lever control as set forth in claim 18 wherein said releasable locking means includes means for selectively engaging said shift actuating member and said housing to prevent relative rotation therebetween.

20. A single lever control as set forth in claim 18 wherein said releasable locking means includes means for selectively engaging said shift actuating member and said warm-up member to prevent relative rotation therebetween.

21. A single lever control as set forth in claim 18 wherein said releasable locking means includes means for selectively engaging said shift actuating member with said housing and with said warm-up member to prevent relative rotation between said shift actuating member and said housing and said warm-up member.

22. A single lever control for operating a throttle and a clutch, said control comprising a housing, a shaft pivotally supported by said housing for rotation about an axis, shift means operably connected to said shaft for actuating the clutch and including a shift actuating member pivotably supported by said housing for rotation about said axis to effect clutch actuation, a throttle actuating member operably connected to the shaft and adapted to be operably connected to the throttle, and warm-up means for permitting operation of said throttle means without operation of said shift means and including a warm-up member which is movable transversely of said axis between a first position and a second position, and a locking member connected to said shift actuating member for common rotational movement therewith about said axis and for movement relative thereto radially of said axis.

23. A single lever control for operating a throttle and a clutch, said control comprising a housing, a shaft pivotably supported by said housing, shift means operably connectable to and disconnectable from said shaft, adapted to be operably connected to the clutch, and including a shift cam which is pivotably supported by said housing, throttle means operably connected to said shaft and adapted to be operably connected to the throttle, and warm-up means including a member which is manually movable transversely of said shaft to effect connection and disconnection of said shaft and said shift means, and which, when said shift means and said shaft are disconnected, permits operation of said throttle means without operation of said shift means, and means for fixing said shift cam to said housing.

24. A single lever control as set forth in claim 23 wherein said shaft is rotatable about an axis, and wherein said member is a warm-up rod slideably supported by said housing for movement transverse to said axis for operably connecting and disconnecting said shaft and said shift means.

25. A single lever control as set forth in claim 24 wherein said warm-up rod is movable between a first position and a second position, and wherein said shift means includes a shift cam which is pivotably supported by said housing, which is rotatable with respect to said housing and is fixed to said shaft when said warm-up rod is in said first position, and which is fixed to said housing and affords rotation of said shaft relative to said shift cam when said warm-up rod is in said second position.

26. A single lever control as set forth in claim 23 wherein said member is a warm-up rod which is supported by said housing for movement between a first position and a second position and includes locking means for fixing said shift cam to said shaft and for affording rotation of said shift cam relative to said housing when said warm-up rod is in said first position, and for fixing said shift cam to said housing and for affording rotation of said shaft relative to said shift cam when said warm-up rod is in said second position.

27. A single lever control as set forth in claim 26 wherein said locking means includes a locking member which is supported by said housing for movement between a first position and a second position, and wherein said locking member includes means for fixing said shift cam to said shaft and affording rotation of said shift cam relative to said housing when said locking member is in said first position, and for fixing said shift cam to said housing and affording rotation of said shaft relative to said shift cam when said warm-up rod is in said second position.

28. A single lever control as set forth in claim 27 wherein said housing has therein a first recess, wherein said shaft is rotatable with respect to a reference position and has therethrough a radially extending bore which is aligned with said first recess when said shaft is in said reference position, wherein said shift cam is rotatable relative to a neutral position and has therein a second recess which is located radially inwardly of said first recess and which is aligned with said bore when said shift cam is in said neutral position and when said shaft is in said reference position, wherein said warm-up means includes a pin which is slideably housed by said bore and which is movable from said bore into said second recess when said shaft is in said reference position and when said shift cam is in said neutral position, and wherein said warm-up means includes means for moving said pin from said bore into said second recess when said warm-up rod is in said first position and for moving said pin out of said second recess and into said bore when said warm-up rod is in said second position, when said shaft is in said reference position and when said shift cam is in said neutral position.

29. A single lever control as set forth in claim 28 wherein said means for moving said pin includes, on said locking member, a second pin which is movable into said bore to move said first pin from said bore and into said second recess when said shaft is in said reference position and when said shift cam is in said neutral position, and a first tab which is located in said second recess and which is engageable with said first pin to move said first pin out of said second recess and into said bore when said shaft is in said reference position and when said shift cam is in said neutral position.

30. A single lever control as set forth in claim 29 wherein said shift cam includes a third recess which is located radially inwardly of said first recess and which is diametrically opposed to said second recess such that said second and third recesses align with said bore and with said first recess when said shift cam is said neutral position and when said shaft is in said reference position, and wherein said second pin is housed in said third recess.

31. A single lever control as set forth in claim 27 wherein said locking member is rotatable with said shift cam relative to said housing when said locking member is in said first position and when said warm-up rod is in said first position.

32. A single lever control as set forth in claim 26 wherein said shift cam is rotatable relative to a neutral position, and further including means for preventing rotation of said shift cam relative to said housing and from said neutral position when said warm-up rod is in said second position.

33. A single lever control as set forth in claim 32 wherein said housing has therein a first recess, said shift cam has therein a second recess, and wherein said means for preventing rotation of said shift cam includes a locking member having means engageable with said first recess and with said second recess when said shift cam is in said neutral position.

34. A single lever control as set forth in claim 23 wherein said shaft is supported by said housing for pivotal movement about an axis, wherein said shift means includes a shift cam pivotably supported by said housing coaxially with said shaft, and wherein said member is slideably supported by said housing for movement transverse to said axis between a first position affording rotation of said shift cam with said shaft relative to said housing and a second position fixing said shift cam to said housing.

35. A single lever control as set forth in claim 23 wherein said shaft is pivotably supported by said housing, wherein said member is slideably supported by said housing for movement transverse to said shaft between a first position and a second position, wherein said shift means includes a shift cam pivotably supported by said housing for coaxial pivotal movement with said shaft relative to a neutral position, and wherein said warm-up means includes means for preventing rotation of said shift cam relative to said shaft when said warm-up rod is in said first position and for preventing rotation of said shift cam relative to said housing from said neutral position when said warm-up rod is in said second position.

36. A single lever control for operating a throttle and a clutch, said control comprising a housing, a shaft supported by said housing for pivotal movement about an axis, said shaft having therethrough a bore extending transverse to said axis, a pin housed by said bore and movable longitudinally thereof between a first position wherein a portion of said pin extends from said bore and a second position wherein said pin is substantially housed by said bore, shift means operably connected to said shaft, adapted to be operably connected to the clutch, and including a shift member engagable with said portion of said pin when said pin is in said first position, throttle means operably connected to said shaft and adapted to be operably connected to the throttle, and warm-up means including means for moving said pin between said first and second positions and comprising a locking member movable transversely of said axis, engaged with said bore and with aid shift member when said pin is in said first position and engaged with said shift member and with said housing when said pin is in said second position.

37. A single lever control for operating a throttle and a clutch, said control comprising a housing, a shaft supported by said housing for pivotal movement about an axis, shift means operably connectable to and disconnectable from said shaft and adapted to be operably connected to the clutch, throttle means operably connected to said shaft and adapted to be operably connected to the throttle, and warm-up means for permitting operation of said throttle means without operation of said shift means, said warm-up means including a locking member supported by said housing for movement between a first position wherein said locking member is engaged with said shift means and with said shaft and a second position wherein said locking member is engaged with said housing and with said shift means.

38. A single lever control as set forth in claim 37 wherein said locking member is movable between said first and second positions in a direction transverse of said axis.

39. A single lever control as set forth in claim 38 wherein said locking member is in surrounding relation to said shaft.

40. A single lever control as set forth in claim 37 wherein said shaft has extending therethrough a bore extending transverse to said axis, and wherein said warm-up means includes a pin housed in aid bore for longitudinal movement relative thereto, and wherein said locking member includes means for moving said pin.

41. A single lever control as set forth in claim 40 wherein said pin is movable between a first position wherein a portion of said pin extends from said bore and a second position wherein said pin is substantially housed by said bore, and wherein said locking member includes means for moving said pin between said first and second positions.

42. A single lever control as set forth in claim 37 wherein said shaft has extending therethrough a bore extending transverse to said axis, and wherein said locking member includes a first portion engaged with said bore when said locking member is in said first portion.

43. A single lever control as set forth in claim 42 wherein said locking member includes a second portion and wherein said first and second portions are engaged with said shift member.

44. A single lever control as set forth in claim 37 wherein said locking member has a third portion which is engaged with said housing when said locking member is in said second position.

45. A single lever control comprising a rotatable shaft adapted to be operably connected one of a throttle and to a clutch, a control lever, a collet fixed to said shaft for common rotation, and means on said collet and on said control lever for connecting said control lever and said collet so as to initially afford rotation of said control lever relative to said collet to a selected position, and for subsequently fixing said control lever to said collet in the selected position.

46. A single lever control as set forth in claim 45 wherein said means connecting said collet and said control lever includes means for effecting non-rotational engagement of said control lever and said collet.

47. A single lever control as set forth in claim 46 wherein said control lever includes a wall defining therein a generally frustoconical bore, wherein said collet includes a generally frustoconical outer surface, and wherein said engagement effecting means causes engagement of said wall and said outer surface.

48. A single lever control as set forth in claim 47 wherein said shaft has an end and has therein a bore extending from said end, and wherein said means connecting said collet and said control lever includes a bolt extending through said collet, having a first end threadedly engaged with said bore in said shaft and having a second end engaged with said collet.

49. A single lever control as set forth in claim 45 wherein said shaft has an externally splined portion, and wherein said collet has an internally splined portion engaged with said externally splined portion of said shaft.

50. A single lever control as set forth in claim 45 wherein said means connecting said collet and said control lever includes means for plastically deforming one of said control lever and said collet.

51. A single lever control as set forth in claim 50 wherein said control lever includes a wall which defines therein a generally frustoconical bore, wherein said collet includes a generally frustoconical outer surface engaging said wall, and wherein said means for plastically deforming one of said control lever and said collet includes means for plastically deforming one of said wall and said outer surface.

52. A single lever control as set forth in claim 51 wherein said deforming means includes, on said other of said frustoconical wall and said outer surface, a plurality of serrations.

53. A single lever control as set forth in claim 52 wherein said plurality of serrations is on said outer surface of said collet.

54. A single lever control comprising rotatable shaft means adapted to be operably connected to a throttle and to a clutch, a control lever, and means for connecting said control lever to said shaft means for initial rotation relative thereto to a selected position and for subsequent common rotation therewith, said connecting means including means for plastically deforming one of said control lever and said shaft means.

55. A single lever control as set forth in claim 54 wherein said shaft means includes a rotatable shaft, and a collet which is engaged with said shaft and which is engagable with said control lever.

56. A single lever control as set forth in claim 55 wherein said control lever includes a wall which defines therein a generally frustoconical bore, wherein said collet includes a generally frustoconical outer surface engaging said wall, and wherein said means for plastically deforming one of said control lever and said shaft means includes means for plastically deforming one of said wall and said outer surface.

57. A single lever control as set forth in claim 56 wherein said deforming means includes, on the other of said frustoconical wall and said outer surface, a plurality of serrations.

58. A single lever control as set forth in claim 57 wherein said plurality of serrations is on said outer surface of said collet.

59. A single lever control as set forth in claim 58 and further comprising a bore in said shaft, and a bolt threadedly engaging said bore in said shaft and extending through and engaging said collet.

60. A single lever control as set forth in claim 54 wherein said shaft means includes a shoulder and wherein said control lever includes a surface engageable with said shoulder to limit axial movement of said control lever relative to said shoulder.

* * * * *